US008647221B1

(12) United States Patent
Hochberg

(10) Patent No.: US 8,647,221 B1
(45) Date of Patent: Feb. 11, 2014

(54) SOCCER TRAINER

(75) Inventor: Seth Hochberg, Plainville, MA (US)

(73) Assignee: Franklin Sports, Inc., Stoughton, MA (US)

( * ) Notice: Subject to any disclaimer, the term of this patent is extended or adjusted under 35 U.S.C. 154(b) by 279 days.

(21) Appl. No.: 13/157,750

(22) Filed: Jun. 10, 2011

(51) Int. Cl.
*A63B 69/00* (2006.01)

(52) U.S. Cl.
USPC ..... 473/446; 473/422

(58) Field of Classification Search
USPC ..... 473/421, 422, 434, 435, 446, 454–456, 473/470, 477, 478; 108/118, 157.17; 248/97; D21/704, 705; 273/397; 482/38
See application file for complete search history.

(56) References Cited

U.S. PATENT DOCUMENTS

| | | | | | |
|---|---|---|---|---|---|
| 560,669 | A | * | 5/1896 | Abel | 108/118 |
| 659,508 | A | * | 10/1900 | Collins | 108/118 |
| 747,822 | A | * | 12/1903 | Wilson | 108/163 |
| 920,907 | A | * | 5/1909 | Bolton | 473/197 |
| 1,658,097 | A | | 2/1928 | Pierce | |
| 2,174,884 | A | | 10/1939 | Kachel | |
| 2,841,797 | A | * | 7/1958 | Kennedy | 4/572.1 |
| 4,239,235 | A | * | 12/1980 | Torres | 473/434 |
| 4,615,528 | A | | 10/1986 | York | |
| 4,703,931 | A | | 11/1987 | Steen | |
| 4,842,284 | A | * | 6/1989 | Rushing et al. | 273/395 |
| 5,165,690 | A | * | 11/1992 | Kelley, Jr. | 473/184 |
| 5,289,897 | A | * | 3/1994 | Wiehe, Jr. | 182/154 |
| 5,615,889 | A | | 4/1997 | Long | |
| 5,938,546 | A | * | 8/1999 | Caruso | 473/434 |
| D420,074 | S | * | 2/2000 | Whitham-Taudien | D21/705 |
| 6,846,253 | B1 | | 1/2005 | Szwalek | |
| 6,935,971 | B2 | | 8/2005 | Piras et al. | |
| D517,620 | S | | 3/2006 | Mazloompour | |
| D537,488 | S | | 2/2007 | Mazloompour | |
| 7,597,558 | B2 | * | 10/2009 | Mazloompour | 434/247 |
| 8,382,116 | B1 | * | 2/2013 | Harris | 273/403 |
| 2004/0176193 | A1 | | 9/2004 | Valliquette | |
| 2013/0072327 | A1 | * | 3/2013 | Hunt | 473/434 |

OTHER PUBLICATIONS

Webpage download, Amazon, 2008,www.amazon.com/Keeper-6345-Canopy-Bungee-Pieces/dp/B000G76PLA, 2 pages.*

* cited by examiner

*Primary Examiner* — Alvin Hunter
*Assistant Examiner* — M Chambers
(74) *Attorney, Agent, or Firm* — Joseph B Bowman

(57) ABSTRACT

A collapsible and easily portable soccer trainer having a pair of spaced apart, X-shaped side frames. The rear legs of the X-shaped side frames are connected to cross members which receive an upright net panel connected to the frame by a plurality of tensioning cords. The forward legs of the X-shaped side frames receive a curvilinear net panel connected to the forward legs by a plurality of tensioning cords. Brace members interconnect the forward legs to maintain uniform separation but are offset from the plane defined by the curvilinear net panel so as to prevent inadvertent deflection of a soccer ball by contact with the rigid frame elements.

10 Claims, 8 Drawing Sheets

SOCCER TRAINER

CROSS-REFERENCE TO RELATED APPLICATIONS

This application references no related application.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a soccer trainer. More specifically, this invention relates to a soccer trainer having two different rebound surfaces to practice ground passing, trapping and shooting skills on one surface and to practice head, chest and thigh passing on the other surface.

Being a team sport, opportunities for individual practice on basic soccer techniques are not always readily available. Numerous training aids have been developed through the years to assist soccer players in practicing on their own or while executing repetitive team drills.

For developing foot skills useful in trapping, passing, and shooting, prior art training devices have typically employed some type of rebound surface such as a tensioned net. Representative examples of rebounding nets may be found in U.S. Pat. Nos. 5,615,889 of Long, 6,846,253 of Szwalek, and 6,935,971 of Piras et al. The speed at which the ball is rebounded is directly influenced by the force of the ball impacting the rebound surface. In U.S. Pat. No. 4,615,528, York teaches a structure that receives and then rolls the soccer ball back to the user at a more controlled velocity. The foregoing devices, however, may be large, heavy, or both, and are cumbersome for a single individual to set up for a practice session. Likewise due to size and weight, such devices are not easily transported or stored.

Another type of prior art soccer training aids is designed for developing head, chest, and thigh contact skills useful in trapping and passing a ball. For this purpose it is necessary that the soccer ball be elevated into the air by a rebounding surface so the user can then practice head butts, chest bumps and thigh kicks for passing control. Mazloompour in U.S. Pat. Nos. D517,620, D537,488, and 7,597,558 teaches a large, concave ramp surface for delivering a ball back in the air. Valliquette in Publication No. US 2004/0176193 discloses a weighted training device having a sloped surface to return a kicked ball back in the air to the user. For all practical purposes the Mazloompour device is virtually a permanent structure due to size and weight. Likewise, when the Valliquette device is weighted it is also virtually a permanent structure.

Accordingly, a need remains in the art of soccer training aids for a portable trainer which overcomes the problems and disadvantages associated with the prior art devices. The primary goal of this invention is to meet this need.

SUMMARY OF THE INVENTION

More specifically, an object of the invention is to provide a light weight and easily portable soccer trainer having two rebound surfaces for developing both foot and upper body soccer skills.

Another object of the invention is to provide a soccer trainer of the character described which is readily collapsible for convenience of storage and transport.

An additional object of the invention is to provide a portable soccer trainer having an upright rebound net to practice ground passing, trapping and shooting skills.

A further object of the invention is to provide a soccer trainer with a curvilinearly tensioned net to reliably loop into the air a soccer ball back to the user to practice head, chest and thigh passing skills.

A corollary to the preceding object of the invention is to provide a soccer trainer with a curvilinearly tensioned net wherein a soccer ball delivered thereto contacts only the net and is not diverted by contact with supporting framework.

In summary, an object of the invention is to provide a collapsible and easily portable soccer trainer having a pair of spaced apart, X-shaped side frames. The rear legs of the X-shaped side frames are connected to cross members which receive an upright net panel connected to the frame by a plurality of tensioning cords. The forward legs of the X-shaped side frames receive a curvilinear net panel connected to the forward legs by a plurality of tensioning cords. Brace members interconnect the forward legs to maintain uniform separation but are offset from the plane defined by the curvilinear net panel so as to prevent inadvertent deflection of a soccer ball by contact with the rigid frame elements.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
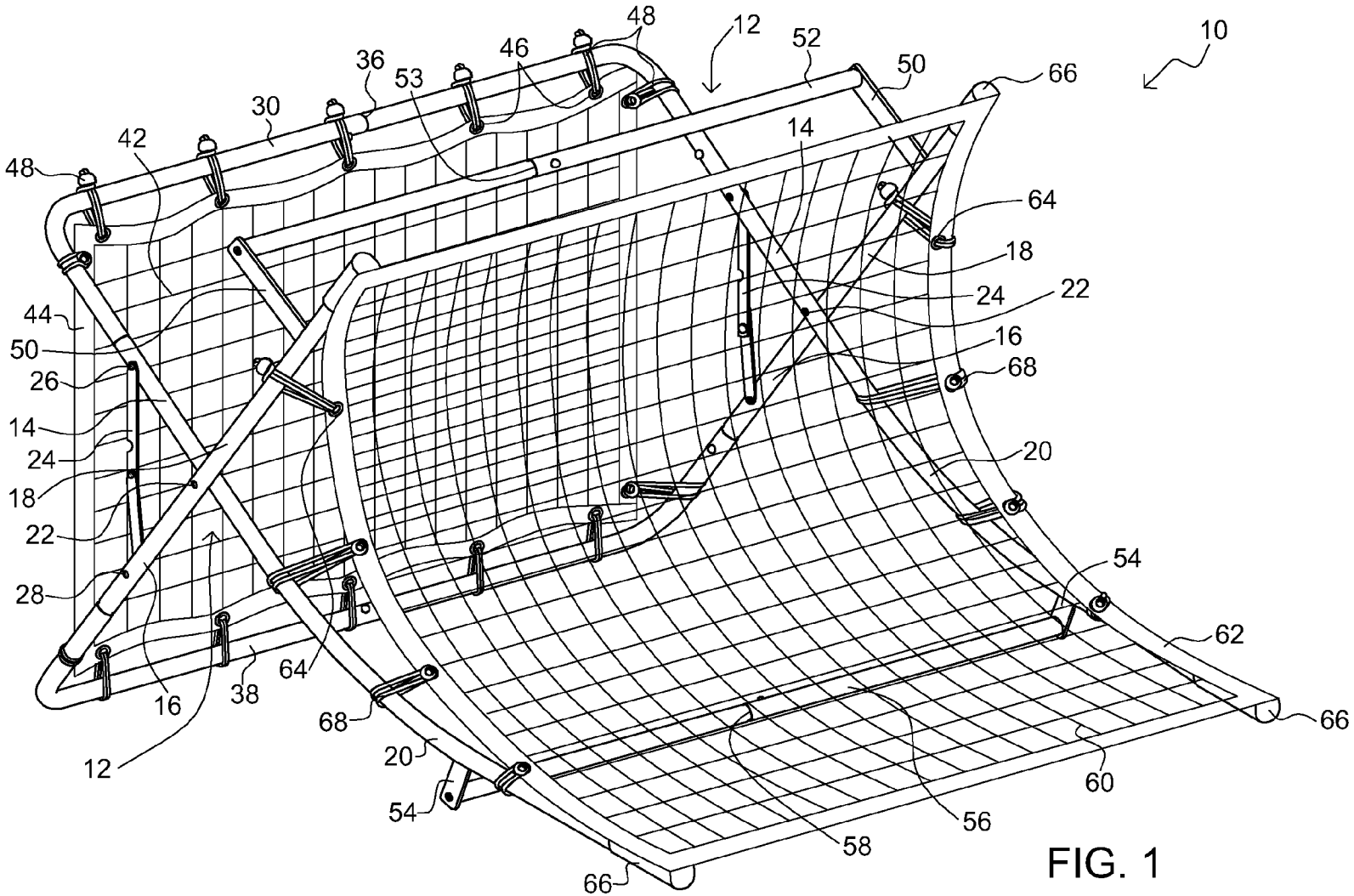
FIG. 1 is a perspective view of a soccer trainer constructed in accordance with one embodiment of the invention.
Figure 5:
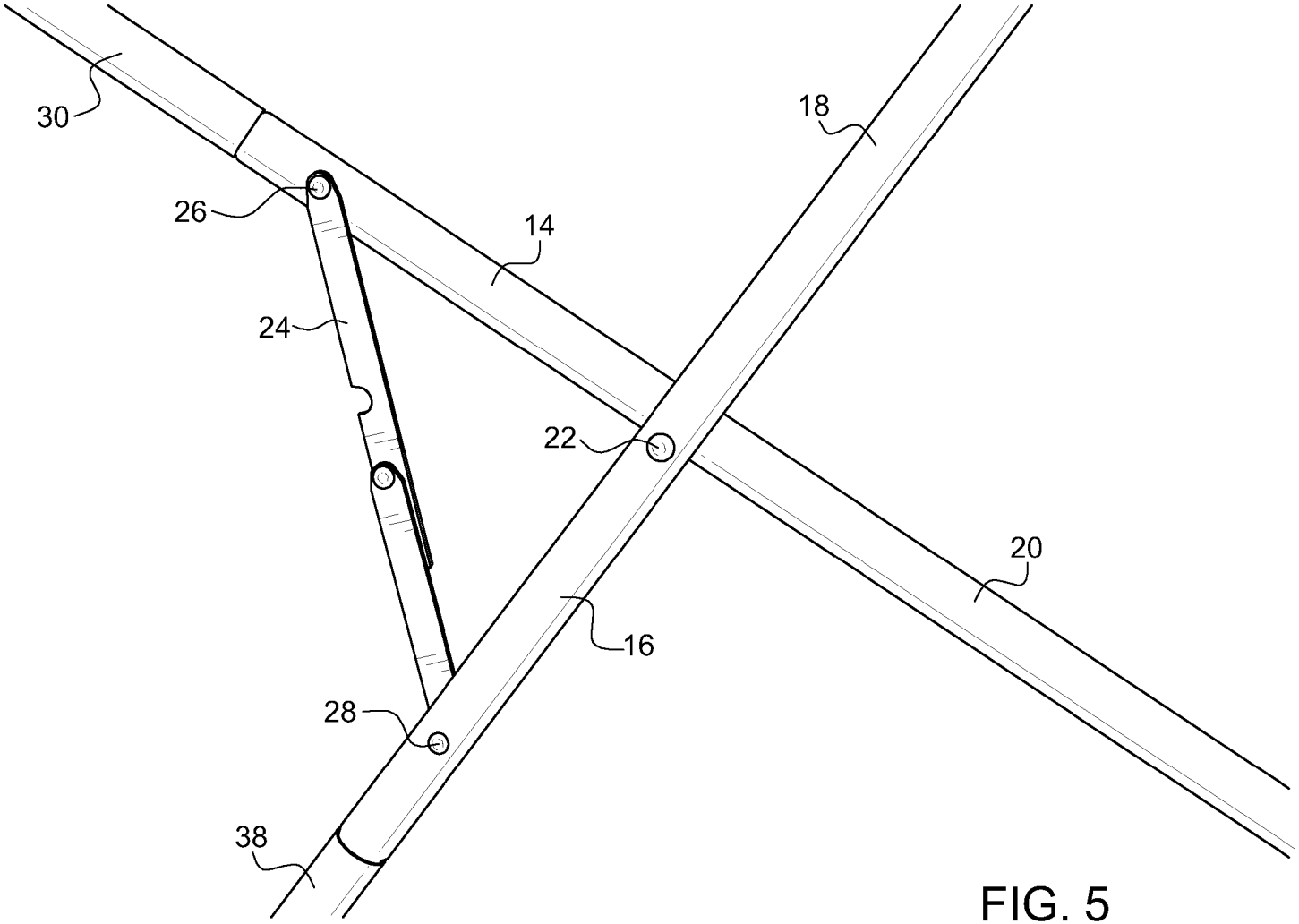
FIG. 5 is a side fragmentary view illustrating the bracing hinge for the collapsible frame.

Referring to the drawings in greater detail, attention is first directed to the illustration of FIG. 1 showing a perspective view of a soccer trainer designated generally by the numeral 10. The trainer 10 includes a pair of spaced apart, X-shaped side frames 12 formed of tubular material. Each side frame 12 comprises upper and lower rear legs 14 & 16 respectively and upper and lower forward legs 18 & 20 respectively. In the illustrated embodiment, lower rear legs 16 are integrally joined and common with upper forward legs 18. Likewise, upper rear legs 14 are integrally joined and common with lower forward legs 20. For each X-shaped side frame 12, the upper rear leg 14 and lower forward leg 20 intersection with the lower rear leg 16 and upper forward leg 18 are connected with a pivot pin 22. The assembled X-shape of the side frames 12 are maintained in a locked position, however, by a hinge brace 24 connected by pivot pins 26 & 28 to the upper and lower rear legs 14 & 16 as shown in greater detail in FIG. 5.

To maintain the upper rear legs 14 in spaced apart relationship, the outermost ends thereof receive a U-shaped tubular cross member 30. The joint for such connections is illustrated in detail in FIG. 6. The outermost ends of the rear legs 14 are necked down in diameter to fit within the inside diameter of the cross member 30. The rear legs 14 also include a spring biased plunger 32 to register with a hole 34 in the cross member 30 to lock the two tubular structures in alignment. It will be understood by those skilled in the art that such parts may be reversed such that the cross member 30 has a necked down diameter to fit within the inside diameter of the rear leg 14 and also has a spring biased plunger to register with a hole in the rear leg 14.

Figure 4:
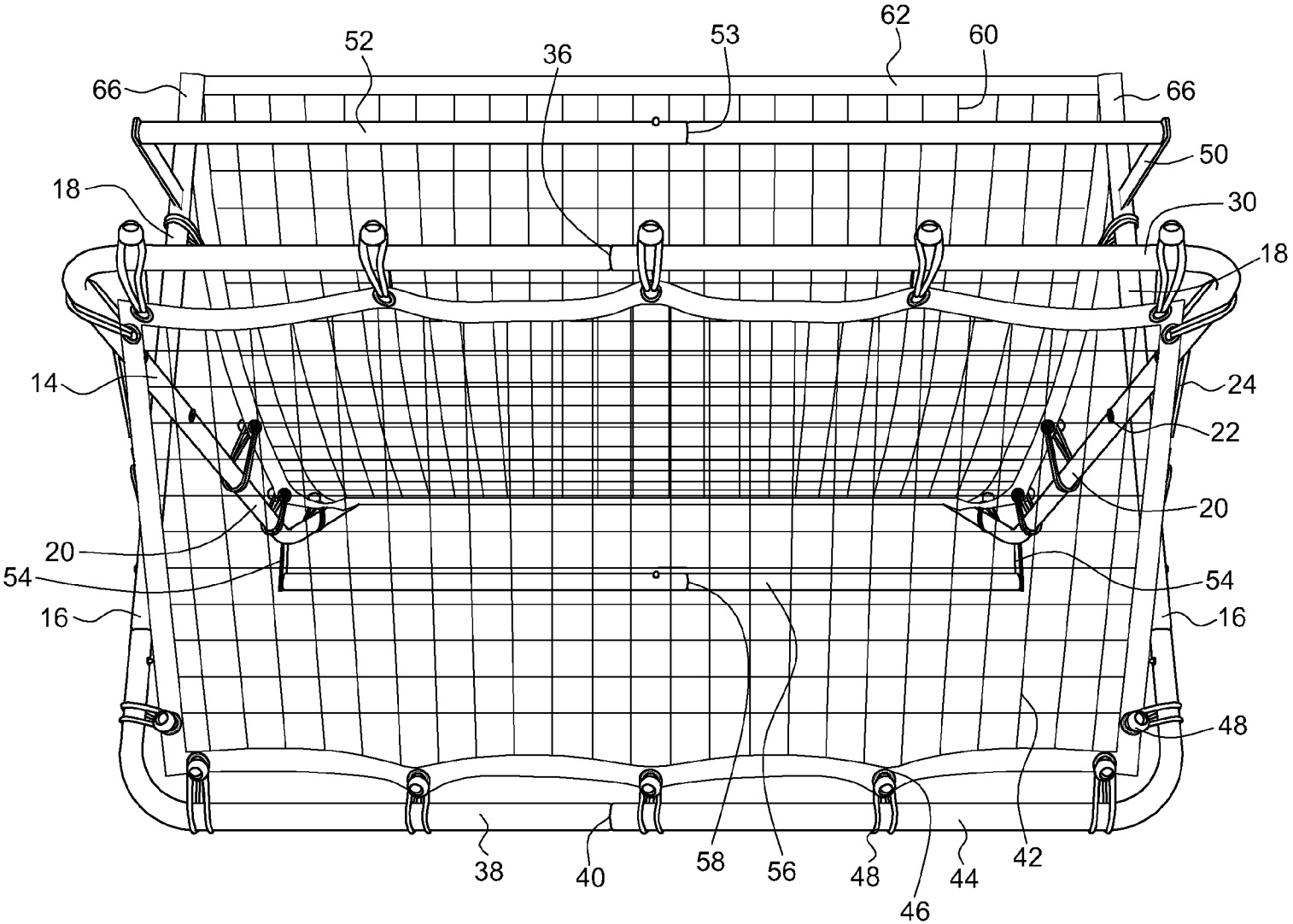
FIG. 4 is a rear elevational view thereof.
Figure 6:
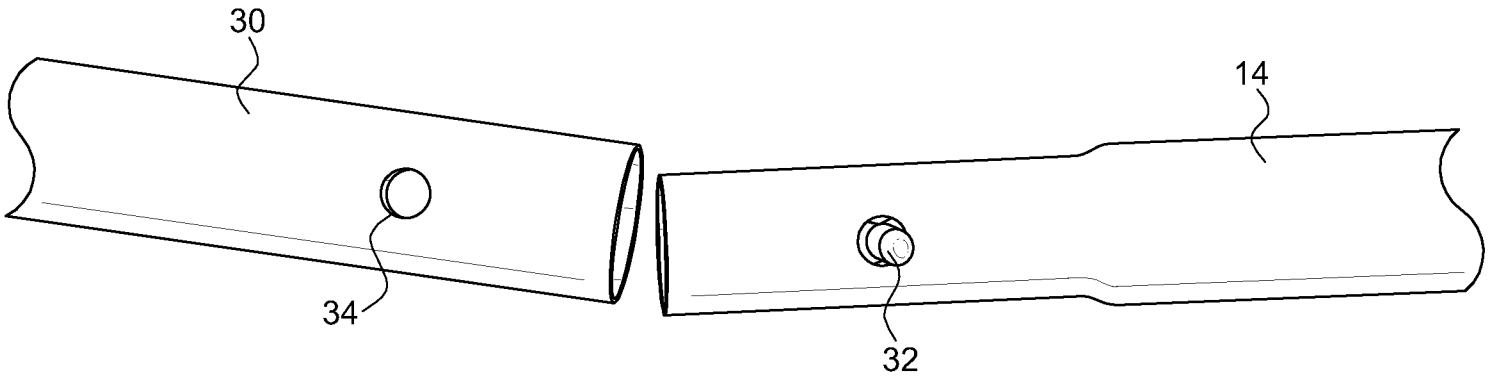
FIG. 6 is an exploded fragmentary view illustrating a tubular joint of the frame.

It will be further understood by those skilled in the art that other tubular lengths of the frame for the soccer trainer 10 may include joints such as illustrated in FIG. 6 in order to reduce the overall length of a tubular element for the purposes of packaging or storage or both. More specifically, the cross member 30 includes such a joint as indicated by the parting line 36 in FIGS. 1 & 4.

Figure 2:
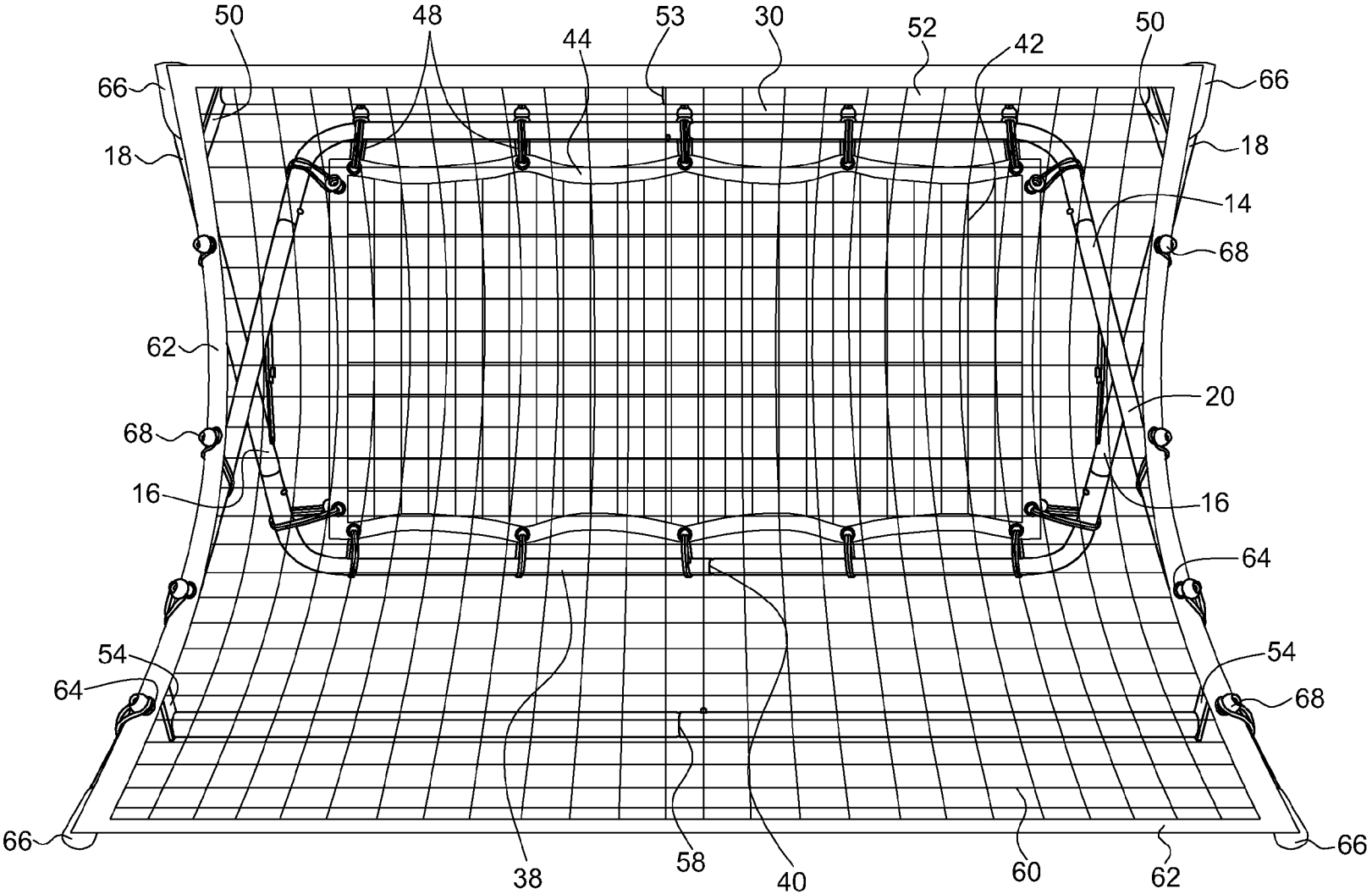
FIG. 2 is a front elevational view of the soccer trainer illustrated in FIG. 1.
Figure 3:
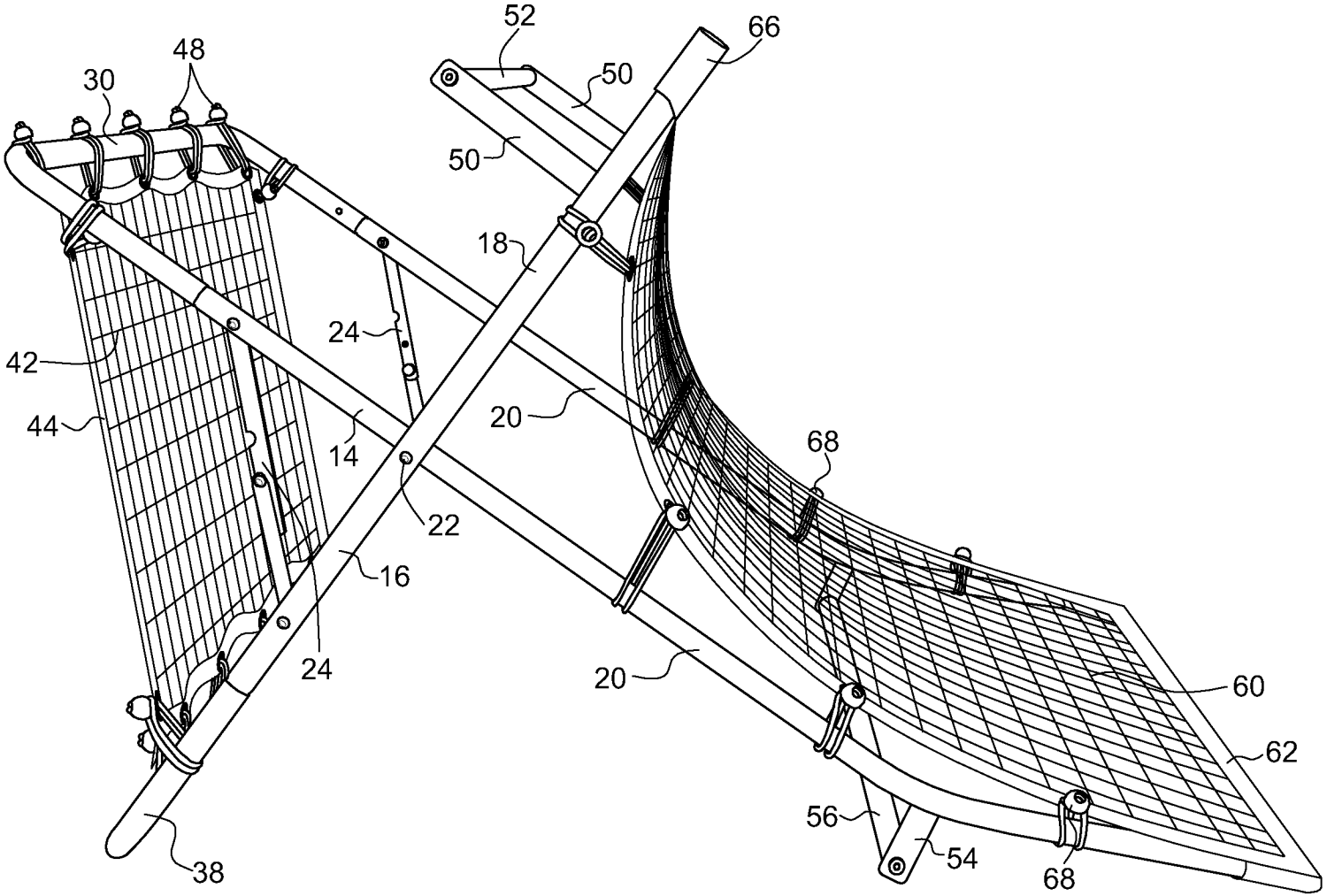
FIG. 3 is a side elevational view thereof.

To maintain the lower rear legs 16 in spaced apart relationship, the outermost ends thereof receive a U-shaped tubular cross member 38 similarly sized and dimensioned to correspond to the cross member 30 previously described. The cross member 38 is removably joined to the lower rear legs 16 by connection joints such as illustrated and described with reference to FIG. 6. In like fashion, the cross member 38 also includes such a joint intermediate its length as indicated by the parting line 40 in FIGS. 2 & 4.

Mounted on the cross members 30 & 38 is a substantially upright, rectangular net panel 42 sized in height to fit between the cross members 30 & 38 and sized in width to fit between the upper rear legs 14 with the extension connections from cross members 30 & 38. The net panel 42 includes a peripheral ribbon or tape 44 through which a plurality of grommets 46 are fitted.

The net panel 42 is held taut to the associated tubular frame members by a plurality of tensioning members 48. Each tensioning member 48 is a bungee cord loop with the free ends thereof secured to a knob. As illustrated in the drawings, the connection is made by passing the bungee cord loop through a grommet 46 in the net panel 42, over the cross member 30 or 38, and finally over the knob of the tensioning member 48.

To maintain the upper forward legs 18 in spaced apart relationship, each upper forward leg 18 has attached a bracket leg 50. Each bracket leg 50 is attached approximately perpendicular to the leg 18 at a location back from the outermost end of the leg 18, and is oriented in a rearward direction. Secured to the ends of the bracket legs 50 is a tubular support brace 52. Constructed in this manner, the support brace 52 which fixes the upper forward legs 18 of the side frames 12 is offset from the geometric plane containing the legs 18. The support brace 52 includes a tubular joint as illustrated in FIG. 6 intermediate its length as indicated by the parting line 53 in FIGS. 1, 2, 4 & 7.

The lower forward legs 20 of the X-shaped side frames 12 are much longer than the upper forward legs 18 and may include a bend or curve towards the outer end. To maintain the lower forward legs 20 in spaced apart relationship, each lower forward leg 20 has attached a short bracket stub 54. Each bracket stub 54 is attached approximately perpendicular to the leg 20 at a location back from the outermost end of the leg 20, and is oriented in a downward direction. Secured to the ends of the bracket stubs 50 is a tubular support brace 56. Constructed in this manner, the support brace 56 which fixes the lower forward legs 20 of the side frames 12 is offset from the geometric plane containing the legs 20. The support brace 56 includes a tubular joint as illustrated in FIG. 6 intermediate its length as indicated by the parting line 58 in FIGS. 1, 2 & 4.

Mounted on the outer ends of the upper and lower forward legs 18 & 20 is a rectangular net panel 60 sized in width to generally correspond to the width between the side frames 12 and sized in height to be longer than the lineal distance between the outer end of the upper forward leg 18 and the outer end of the lower forward leg 20. The net panel 60 includes a peripheral ribbon or tape 62 through which a plurality of grommets 64 are fitted. Each corner of the net panel 60 includes a tubular pocket 66 attached to the tape 62 in order to receive the outer ends of the tubular legs 18 or 20.

In addition to the tubular pockets 66, the net panel 60 is also connected to the upper and lower forward legs 18 & 20 by a plurality of tensioning members 68. Each tensioning member 68 is a bungee cord loop with the free ends thereof secured to a knob. As illustrated in the drawings, the connection is made by passing the bungee cord loop through a grommet 64 in the net panel 60, over the forward leg 18 or 20, and finally over the knob of the tensioning member 68. Since the net panel 60 is sized in height to be longer than the lineal distance between the outer end of the upper forward leg 18 and the outer end of the lower forward leg 20, the net panel 60 might sag but for the tensioning members 68 connecting the net panel 60 to the upper and lower forward legs 18 & 20 which cause the net panel 60 to conform to a curvilinear plane spanning the area between the forward legs 18 & 20 of the side frames 12.

Thus constructed, it is intended that cross member 38 interconnecting the lower rear legs 16, the support brace 56 interconnecting the lower forward legs 20, and the outer ends of the lower forward legs 20 may be ground engaging so as to present the leading edge of the net panel 60 at substantially ground level.

Figure 8:
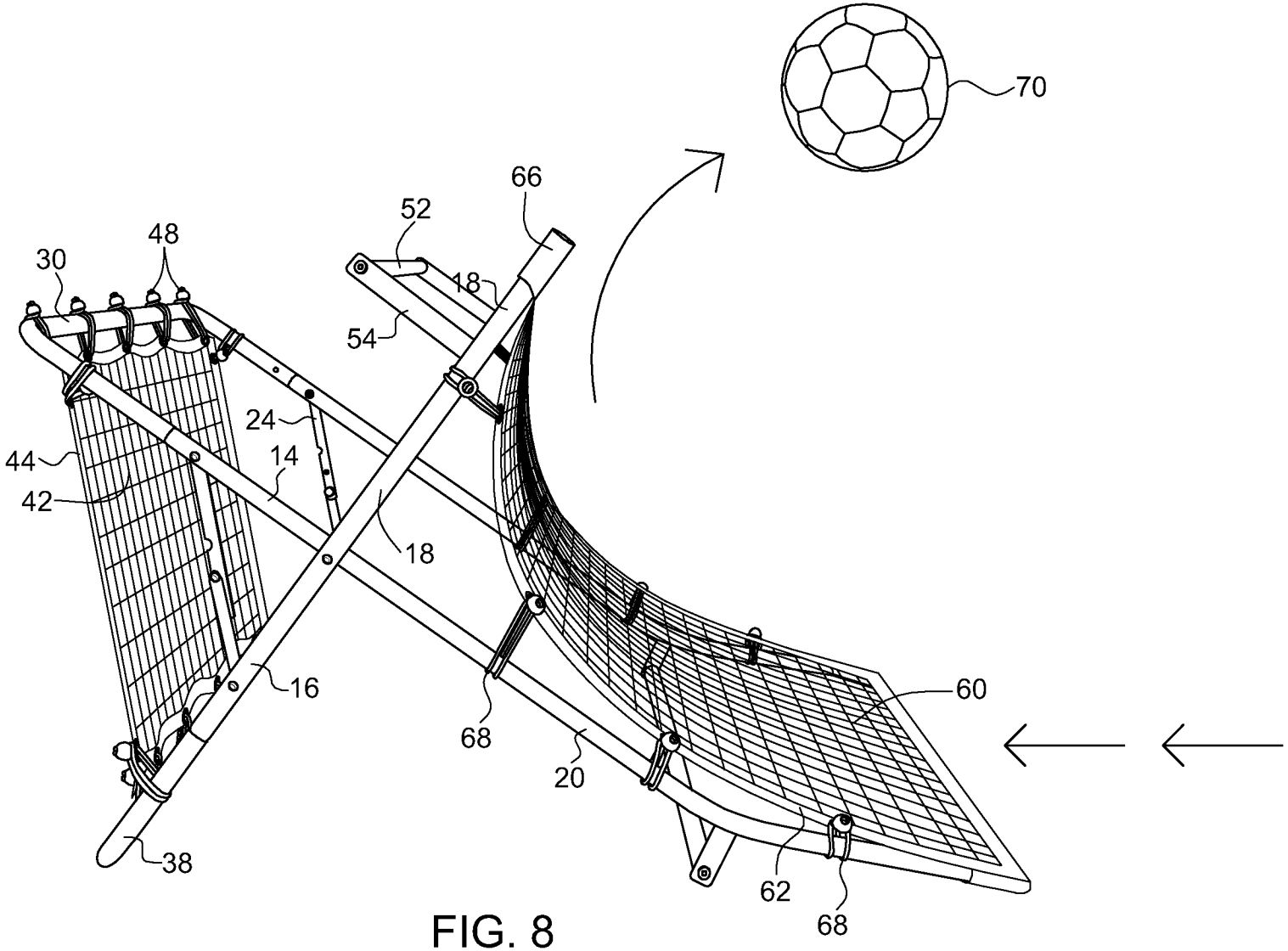
FIG. 8 is a side perspective view to illustrate a soccer ball being looped back in the air from the curvilinear net attached to the frame of the soccer trainer.

In operation, therefore, one practicing soccer skills may place the assembled soccer trainer 10 on the ground as oriented in the drawings. Soccer balls directed to the rearmost net panel 42 are expected to rebound on the ground to the user so that foot skills associated with passing, trapping and shooting may be practiced. Soccer balls 70 directed to the forwardmost net panel 60 are expected to roll up the curvilinear surface and be looped back in the air to the user as illustrated in FIG. 8 so that upper body skills such as head, chest and thigh passing may be practiced. It should be noted that as a result of the support bracing members 52 and 56 being offset from the curvilinear surface of the net panel 60, the soccer ball 70 will consistently be looped back to the user rather than being unexpectedly deflected by contact with a rigid frame element of the trainer 10.

Figure 7:
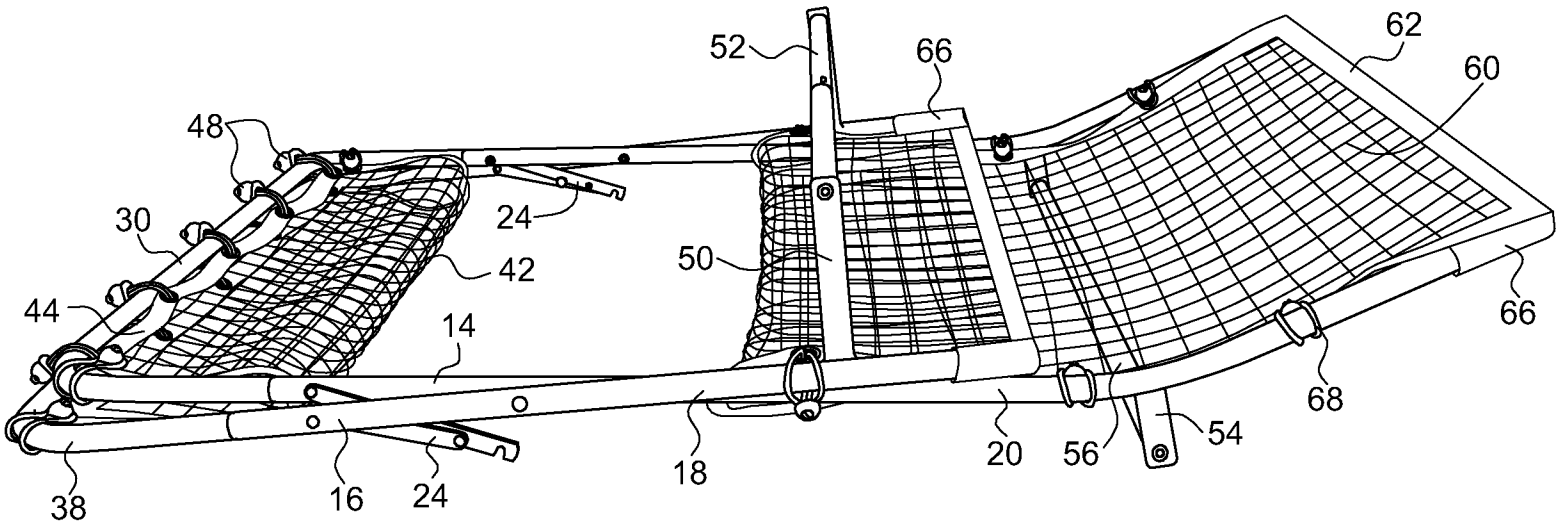
FIG. 7 is a side perspective view of the soccer trainer collapsed to a storage condition.

When not in use, the soccer trainer 10 may be readily collapsed for storage by pivoting the hinge braces 24 in order to permit the trainer 10 to be folded to the condition as shown in FIG. 7. This state is normally very convenient to both transport and storage, yet the trainer 10 can be quickly restored to the assembled condition by positioning the side frames 12 into the X-shape configuration and locking the hinge braces 24. If an even more compact storage solution is needed, the net panel 42 may be removed by disconnecting the tensioning members 48, the net panel 60 may be removed by disconnecting the tensioning members 68 and removing the net pockets 66 from the outer ends of the forward legs 18 & 20, the cross members 30 & 38 may be disconnected from upper and lower rear legs 14 & 16, and the overall length of cross members 30 & 38 and support braces 52 & 56 may be reduced by disconnecting the intermediate tubular joints therein. Thereafter, the trainer 10 can be reassembled by reversing the foregoing steps.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A soccer trainer comprising:

a frame having a pair of spaced apart X-shaped side frames each including first and second rear legs and first and second front legs wherein said second front leg is substantially longer than said first front leg, and each including a pivot point between said legs;

a first brace member interconnecting said first front legs of said X-shaped side frames at a location remote from the outer ends of said first front legs and offset from the plane defined by said first front legs;

a second brace member interconnecting said second front legs of said X-shaped side frames at a location remote from the outer ends of said second front legs and offset from the plane defined by said second front legs;

a curvilinear net panel disposed between the outer ends of said first and second front legs of said X-shaped side frames and extending away from said pivot points of said X-shaped side frames; and a plurality of resiliently yieldable tension members removably connecting said curvilinear net panel to said first and second front legs of said X-shaped side frames;

wherein a soccer ball directed to contact with said curvilinear net panel will be looped back into the air.

2. The soccer trainer as in claim 1, each said X-shaped side frame being pivotally pinned at the juncture of said legs whereby said side frames may be collapsed to lay substantially flat for purposes of storage.

3. The soccer trainer as in claim 2, including a hinge brace interconnecting said first and second rear legs of said X-shaped side frames in order to lock said side frames in a substantially X-shaped configuration.

4. The soccer trainer as in claim 1, each said resiliently yieldable tension member comprising a continuous loop of bungee cord attached to a bulbous keeper.

5. A soccer trainer comprising:

a frame having a pair of spaced apart X-shaped side frames each including first and second rear legs and first and second front legs wherein said second front leg is substantially longer than said first front leg, and each including a pivot point between said legs;

a first cross member interconnecting said first rear legs of said X-shaped side frames;

a second cross member interconnecting said second rear legs of said X-shaped side frames;

a first brace member interconnecting said first front legs of said X-shaped side frames at a location remote from the outer ends of said first front legs and offset from the plane defined by said first front legs;

a second brace member interconnecting said second front legs of said X-shaped side frames at a location remote from the outer ends of said second front legs and offset from the plane defined by said second front legs;

a planar net panel disposed substantially upright between said first and second cross members interconnecting said first and second rear legs of said X-shaped side frames;

a plurality of resiliently yieldable tension members removably connecting said planar net panel to said first and second cross members;

a curvilinear net panel disposed between the outer ends of said first and second front legs of said X-shaped side frames and extending away from said pivot points of said X-shaped side frames; and a plurality of resiliently yieldable tension members removably connecting said curvilinear net panel to said first and second front legs of said X-shaped side frames;

wherein a soccer ball directed to contact with said planar net panel will substantially rebound on the ground and a soccer ball directed to contact with said curvilinear net panel will be looped back into the air.

6. The soccer trainer as in claim 5, each said X-shaped side frame being pivotally pinned at the juncture of said legs whereby said side frames may be collapsed to lay substantially flat for purposes of storage.

7. The soccer trainer as in claim 6, including a hinge brace interconnecting said first and second rear legs of said X-shaped side frames in order to lock said side frames in a substantially X-shaped configuration.

8. The soccer trainer as in claim 5, said first cross member interconnecting the outer ends of said first rear legs of said X-shaped side frames, and said second cross member interconnecting the outer ends of said second rear legs of said X-shaped side frames.

9. The soccer trainer as in claim 5, each said resiliently yieldable tension member comprising a continuous loop of bungee cord attached to a bulbous keeper.

10. The soccer trainer as in claim 5, said first and second rear legs of said X-shaped side frames being of tubular construction and said first and second cross members also being of tubular construction to interlockingly but removably mate with the corresponding first and second rear legs of said X-shaped side frames.

* * * * *